United States Patent [19]

Mallette

[11] 4,322,078

[45] Mar. 30, 1982

[54] BOWLING PIN BASE

[75] Inventor: Rodney C. Mallette, Lowville, N.Y.

[73] Assignee: AMF Incorporated, White Plains, N.Y.

[21] Appl. No.: 160,783

[22] Filed: Jun. 18, 1980

[51] Int. Cl.[3] ..... A63D 9/00

[52] U.S. Cl. ..... 273/82 B; 273/DIG. 22

[58] Field of Search ..... 273/82 R, 82 A, 82 B, 273/DIG. 22

[56] References Cited

U.S. PATENT DOCUMENTS

| | | | |
|---|---|---|---|
| 2,738,977 | 3/1956 | Riley | 273/82 R |
| 3,142,600 | 7/1964 | Dosker | 273/82 R X |
| 3,445,113 | 5/1969 | Satchell et al. | 273/82 A |
| 3,525,524 | 8/1970 | Schmid | 273/82 B |
| 3,940,146 | 2/1976 | Little | 273/DIG. 22 |
| 3,971,837 | 7/1976 | Hasegawa | 273/82 R X |

FOREIGN PATENT DOCUMENTS

| | | | |
|---|---|---|---|
| 436075 | 11/1967 | Switzerland | 273/82 R |

*Primary Examiner*—Richard J. Apley

*Attorney, Agent, or Firm*—George W. Price; Walter Lewis

[57] ABSTRACT

An exterior lock groove is formed in the bowling pin base insert and the insert is locked in place by flow of the exterior plastic coat on the pin into the groove.

1 Claim, 2 Drawing Figures

BOWLING PIN BASE

This invention relates to bowling pins, and more particularly, to an improved bowling pin base.

Briefly, in present bowling pins a nylon or other bowling pin base insert is connected to the bottom of the wood pin core by forming an undercut in a groove in the wood and then heating one end of the insert to cause the plastic to flow into the undercut to lock the two parts together. The disadvantage of this locking mechanism is that whether or not a good locking of the parts together has been obtained can't be seen, and in addition, with long life pins the wood shears away at the undercut whereby the parts separate, and there is then no practical way of repairing the pins.

In the instant invention the above discussed disadvantages of the prior art are overcome. Briefly, since the wood pin core is encapsulated in plastic I lock the base insert to the encapsulating plastic instead of the wood.

Figure 1:
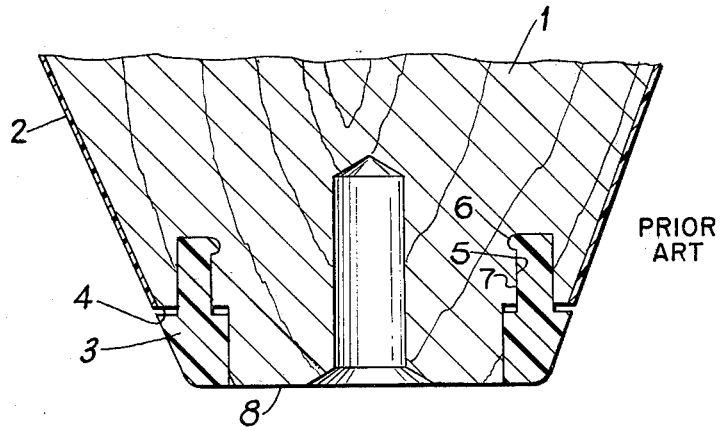
Figure 2:
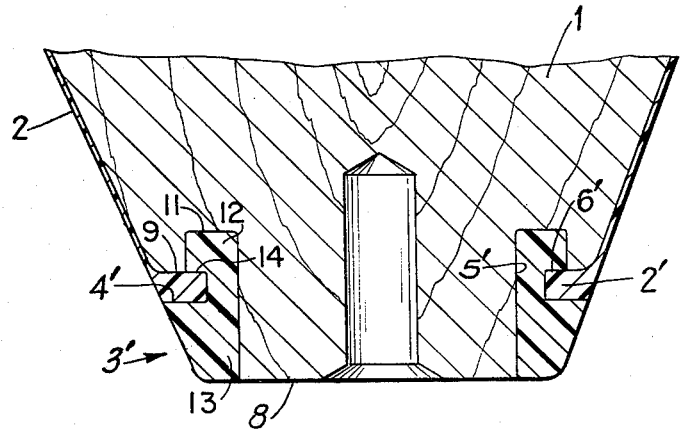

The invention will be best understood by considering the following detailed description taken in connection with the accompanying sheet of drawing in which FIG. 1 is a sectional view of the prior art locking mechanism, and FIG. 2 is a sectional view of the locking mechanism of the instant invention.

Referring particularly first to FIG. 1, shown therein is the bottom end of a bowling pin. The pin comprises a wood core 1, an encapsulating plastic coating 2, and a plastic base insert 3. An exterior facing annular step or groove 4 is cut in the base of the wood core 1. The base insert 3 nests in this groove 4. Another groove 5 is cut in the wood, including an undercut 6 at its inner end. The insert 3 is locked to the wood by heating the inner end of the insert to soften it so that when it is inserted into the groove 5 its material flows into the undercut 6 to lock the parts together. The short comings of this arrangement are several. For one, the inner end of the inserts have to be heated, which requires a separate manufacturing or assembly step, and the soundness of the lock at the undercut 6 can't be visually inspected. Additionally though, it is not uncommon for the wood to shear off at the area 7 below the undercut 6. When this happens the insert will separate from the pins and there is no practical way of repairing the pin.

This problem of loss of the base insert is important since it is an important part of the flat base surface 8 of the pin. Typically these inserts are made from a tough long life plastic, such as nylon, so that the pin will stand up straight despite the severe use to which the pins are put in terms of knocking them about. Although not restricted thereto, the invention is very useful in ionomer resin clad or coated wood core pins of the type disclosed in co-pending Frillici and Infantino patent application Ser. No. 893,369 filed 4/4/78 and assigned to the same assignee as the instant invention. Said material is available from E. I. du Pont de Nemours and Company as Surlyn ionomer resins.

When the encapsulating plastic coating 2 is Surlyn ionomer resin, the pins have an extremely long life assuming that the base inserts will not separate. In FIG. 2 is shown an improved locking arrangement for the base inserts which in terms of life expectancy is commensurate with Surlyn clad wood core bowling pins.

Referring particularly now to FIG. 2, two grooves 4' and 5' comparable to 4 and 5 respectively of FIG. 1 are formed in the wood 1. However, in FIG. 2 instead of an undercut locking groove 6 such as in FIG. 1 being formed in the wood, a locking groove 6' is formed in the insert 3' itself. In this arrangement the Surlyn or ionomer resin coating is caused to flow into the groove 6' to lock the insert 3' to the pin, however not directly to the wood itself, but to the encapsulating coating. The Surlyn coating or cladding 2 is very tough and fits on the wood pin core like a sock, so is a much stronger lock of the insert to the pin than the wood itself could ever be.

As seen in FIG. 2, the bottom annular corner of the core has a peripherally extending exterior facing groove formed therein with the groove being generally L-shaped in cross section. The base portion 11 of the L-shaped groove is spaced radially inwardly from the outer surface of the core thereby leaving a peripherally extending core flange 9. The base portion 11 is spaced longitudinally inwardly from the core flange 9. The insert 3' is seated in the L-shaped groove with the locking groove 6' facing radially outwardly. The base portion 12 of the insert 3' is seated in the base portion 11 of the L-shaped groove such that the lower surface 14 of the locking groove 6' is coplanar with the core flange 9. The upper portion 13 of the insert extends outwardly from the base portion 11 so as to be substantially coextensive with the outer surface of the core and to complete the base of the bowling pin. The coating 2 terminates in a thick inwardly extending annular flange which extends into the core flange 9 and the locking groove 6' thereby locking the insert to the core and the coating.

In FIG. 2 there can be no loss of the base insert by virtue of shearing off of the wood. Also, the step of heating the insert is omitted. In FIG. 1 the Surlyn coating initially is in the shape of two preformed shells which are molded together about the wood core 1 in a heated mold. This is done before the inserts 3 are added. In FIG. 2 the insert adding step is instead incorporated into the manufacturing step of forming the coating 2. That is to say, the insert 3' is added to the wood core, and that subassembly is then put into the heated mold with the two Surlyn half shells. In other words, the step of locking the insert to the pin is incorporated into the step of molding the coating 2 on the wood core. Simultaneously a portion 2' of the cladding or coating 2 flows into the groove 6' of the insert to lock the insert and coating together.

In the FIG. 1 prior art arrangement it was difficult to get the proper undercut 6 on a repetitive base. In FIG. 2 no undercut is required. Also, in FIG. 1 blows on the inserts 3 due to knocking about of the pins were directly imposed on the wood causing it to shear at area 7. In FIG. 2 blows on the inserts may still be imposed on the wood, but there's no comparable area of weakness in the wood that might result in loss of the base insert, and the inserts are held on to the pins by the much tougher Surlyn coating 2. Finally, and not least of the advantages of the invention, is the ability to visually inspect the efficacy of the locking together of the parts. In FIG. 1 this is impossible since the lock is inside the pin where it can't be seen. By contrast, in FIG. 2 it is on the outside of the pin where it can be seen. That is to say, by visual inspection it can be seen if there has been a proper flow of the plastic 2' into the locking groove 6', whereas this is not true of the plastic in the locking groove 6 of FIG. 1.

I claim:

1. In a bowling pin comprising an all wood core having an exposed wood flat bottom surface, an exterior plastic ionomer resin cladding on said wood core, and a nylon base insert at the bottom of said core, the bottom annular corner of said core having a peripherally extending exterior facing groove formed therein, said corner groove being generally L-shaped in cross section and said L-shape facing radially outward, the base portion of the L-shaped groove being spaced radially inwardly from the outer surface of said core thereby leaving a peripherally extending core flange, said base portion further being spaced longitudinally inwardly from said core flange, said nylon base insert being annular in shape and having an annular exterior facing central groove extending thereabout whereby said nylon base insert is generally C-shaped in cross section, said base insert being seated in said L-shaped corner groove, the base portion of said C-shaped insert being seated in said base portion of said L-shaped groove such that the lower surface of said central groove is coplanar with said core flange, the upper portion of said C-shaped insert extending outwardly from said base portion of said insert and being substantially coextensive with the outer surface of said core and in conjunction with said flat bottom of said core completing the base of said bowling pin, and said cladding at the bottom of said pin terminating in a thick inwardly-extending annular flange, said bottom cladding flange extending into said core flange and the annular groove of the C-shape of said insert to lock said insert to said wood core and cladding.

* * * * *